US009770114B2

(12) United States Patent
Brosnan et al.

(10) Patent No.: US 9,770,114 B2
(45) Date of Patent: Sep. 26, 2017

(54) INFLATABLE AIR MATTRESS WITH INTEGRATED CONTROL

(71) Applicant: Select Comfort Corporation, Minneapolis, MN (US)

(72) Inventors: Aran Brosnan, Minneapolis, MN (US); Yi-ching Chen, Maple Grove, MN (US); John McGuire, New Hope, MN (US)

(73) Assignee: Select Comfort Corporation

( * ) Notice: Subject to any disclaimer, the term of this patent is extended or adjusted under 35 U.S.C. 154(b) by 128 days.

(21) Appl. No.: 14/586,694

(22) Filed: Dec. 30, 2014

(65) Prior Publication Data

US 2015/0182033 A1 Jul. 2, 2015

Related U.S. Application Data

(60) Provisional application No. 61/921,615, filed on Dec. 30, 2013.

(51) Int. Cl.

| | |
|---|---|
| ***A47C 27/08*** | (2006.01) |
| ***H04W 4/00*** | (2009.01) |
| ***A47C 31/00*** | (2006.01) |

(52) U.S. Cl.

CPC ..... *A47C 27/082* (2013.01); *A47C 27/081* (2013.01); *A47C 27/083* (2013.01); *A47C 31/008* (2013.01); *H04W 4/005* (2013.01)

(58) Field of Classification Search

CPC ..... A47C 27/08; A47C 27/081; A47C 27/082; A47C 27/083; A47C 31/00; A47C 31/008; H04W 4/005; A61G 7/015; A61G 7/012

See application file for complete search history.

(56) References Cited

U.S. PATENT DOCUMENTS

| | | | |
|---|---|---|---|
| 3,727,606 | A | 4/1973 | Sielaff |
| 4,146,885 | A | 3/1979 | Lawson, Jr. |
| 4,299,233 | A | 11/1981 | Lemelson |
| 4,657,026 | A | 4/1987 | Tagg |
| 4,662,012 | A | 5/1987 | Tarbet |

(Continued)

FOREIGN PATENT DOCUMENTS

| | | |
|---|---|---|
| JP | 2004/229875 | 8/2004 |
| WO | WO 2004/082549 | 9/2004 |

(Continued)

OTHER PUBLICATIONS

U.S. Appl. No. 14/146,281, Palashewski et al., filed Jan. 2, 2014.

(Continued)

*Primary Examiner* — Robert G Santos
*Assistant Examiner* — David R Hare
(74) *Attorney, Agent, or Firm* — Fish & Richardson P.C.

(57) ABSTRACT

An air bed system including a plurality of peripheral devices and a pump unit configured to adjust a firmness of an air mattress, the pump unit including a pump. The system further includes a controller configured to execute instructions that cause the pump unit to wirelessly pair with at least one of the plurality of peripheral devices. The pump unit is configured to receive at least one control signal addressed to the at least one of the plurality of peripheral devices, and transmit the at least one control signal to the addressed device.

12 Claims, 4 Drawing Sheets

(56) References Cited

U.S. PATENT DOCUMENTS 5,062,169 A 11/1991 Kennedy et al.
5,170,522 A 12/1992 Walker
5,197,490 A 3/1993 Steiner et al.
5,235,258 A * 8/1993 Schuerch ..... A61G 7/018 318/16
5,459,452 A 10/1995 DePonte
5,509,154 A 4/1996 Shafer et al.
5,515,865 A 5/1996 Scanlon
5,564,140 A 10/1996 Shoenhair et al.
5,642,546 A 7/1997 Shoenhair
5,652,484 A 7/1997 Shafer et al.
5,675,855 A 10/1997 Culp
5,684,460 A 11/1997 Scanlon
5,699,038 A 12/1997 Ulrich et al.
5,724,990 A 3/1998 Ogino
5,765,246 A 6/1998 Shoenhair
5,771,511 A 6/1998 Kummer et al.
5,796,340 A 8/1998 Miller
5,815,864 A * 10/1998 Sloop ..... A61G 7/05769 5/706
5,844,488 A 12/1998 Musick
5,848,450 A 12/1998 Oexman et al.
5,903,941 A 5/1999 Shafer et al.
5,904,172 A 5/1999 Gifft et al.
5,948,303 A 9/1999 Larson
5,964,720 A 10/1999 Pelz
5,989,193 A 11/1999 Sullivan
6,008,598 A * 12/1999 Luff ..... A47C 31/008 318/16
6,024,699 A 2/2000 Surwit et al.
6,037,723 A 3/2000 Shafer et al.
6,058,537 A * 5/2000 Larson ..... A47C 27/082 5/710
6,062,216 A 5/2000 Corn
6,108,843 A * 8/2000 Suzuki ..... A47C 27/082 5/713
6,120,441 A 9/2000 Griebel
6,146,332 A 11/2000 Pinsonneault et al.
6,147,592 A 11/2000 Ulrich et al.
6,161,231 A 12/2000 Kraft et al.
6,202,239 B1 3/2001 Ward et al.
6,208,250 B1 3/2001 Dixon et al.
6,234,642 B1 5/2001 Bokaemper
6,272,378 B1 8/2001 Baumgart-Schmitt
6,396,224 B1 5/2002 Luff et al.
6,397,419 B1 6/2002 Mechache
6,438,776 B2 8/2002 Ferrand et al.
6,450,957 B1 9/2002 Yoshimi et al.
6,468,234 B1 10/2002 Ford et al.
6,483,264 B1 * 11/2002 Shafer ..... A47C 27/082 318/16
6,485,441 B2 11/2002 Woodward
6,546,580 B2 4/2003 Shimada
6,547,743 B2 4/2003 Brydon
6,561,047 B1 5/2003 Gladney
6,566,833 B2 5/2003 Bartlett
6,686,711 B2 2/2004 Rose et al.
6,708,357 B2 3/2004 Gaboury et al.
6,719,708 B1 4/2004 Jansen
6,763,541 B2 * 7/2004 Mahoney ..... A47C 27/082 5/655.3
6,778,090 B2 8/2004 Newham
6,804,848 B1 10/2004 Rose
6,832,397 B2 12/2004 Gaboury et al.
6,840,117 B2 1/2005 Hubbard, Jr.
6,840,907 B1 1/2005 Brydon
6,847,301 B1 1/2005 Olson
6,878,121 B2 4/2005 Krausman
6,883,191 B2 4/2005 Gaboury et al.
6,993,380 B1 1/2006 Modarres
7,041,049 B1 5/2006 Raniere
7,077,810 B2 7/2006 Lange et al.
7,150,718 B2 12/2006 Okada
7,237,287 B2 7/2007 Weismiller et al.
7,253,366 B2 8/2007 Bhai
7,304,580 B2 12/2007 Sullivan et al.
7,314,451 B2 1/2008 Halperin et al.
7,321,811 B1 1/2008 Rawls-Meehan
7,330,127 B2 2/2008 Price et al.
7,389,554 B1 6/2008 Rose
7,396,331 B2 7/2008 Mack
7,429,247 B2 9/2008 Okada et al.
7,437,787 B2 10/2008 Bhai
7,465,280 B2 12/2008 Rawls-Meehan
7,480,951 B2 1/2009 Weismiller
7,506,390 B2 3/2009 Dixon et al.
7,520,006 B2 4/2009 Menkedick et al.
7,524,279 B2 4/2009 Auphan
7,532,934 B2 5/2009 Lee et al.
7,538,659 B2 5/2009 Ulrich
7,568,246 B2 8/2009 Weismiller et al.
7,637,859 B2 12/2009 Lindback et al.
7,652,581 B2 1/2010 Gentry et al.
7,666,151 B2 2/2010 Sullivan et al.
7,669,263 B2 3/2010 Menkedick et al.
7,676,872 B2 3/2010 Block et al.
7,685,663 B2 3/2010 Rawls-Meehan
7,699,784 B2 4/2010 Wan Fong et al.
7,717,848 B2 5/2010 Heruth et al.
7,749,154 B2 7/2010 Cornel
7,784,128 B2 8/2010 Kramer
7,785,257 B2 8/2010 Mack et al.
7,805,785 B2 10/2010 Rawls-Meehan
7,841,031 B2 11/2010 Rawls-Meehan
7,849,545 B2 12/2010 Flocard et al.
7,854,031 B2 12/2010 Rawls-Meehan
7,860,723 B2 12/2010 Rawls-Meehan
7,862,523 B2 1/2011 Ruotoistenmaki
7,865,988 B2 1/2011 Koughan et al.
7,868,757 B2 1/2011 Radivojevic et al.
7,869,903 B2 1/2011 Turner et al.
7,886,387 B2 * 2/2011 Riley ..... A47C 27/082 5/706
7,930,783 B2 4/2011 Rawls-Meehan
7,933,669 B2 4/2011 Rawls-Meehan
7,953,613 B2 5/2011 Gizewski
7,954,189 B2 6/2011 Rawls-Meehan
7,956,755 B2 6/2011 Lee et al.
7,967,739 B2 6/2011 Auphan
7,979,169 B2 7/2011 Rawls-Meehan
8,019,486 B2 9/2011 Rawls-Meehan
8,020,230 B2 9/2011 Rawls-Meehan
8,028,363 B2 10/2011 Rawls-Meehan
8,032,263 B2 10/2011 Rawls-Meehan
8,032,960 B2 10/2011 Rawls-Meehan
8,046,114 B2 10/2011 Rawls-Meehan
8,046,115 B2 10/2011 Rawls-Meehan
8,046,116 B2 10/2011 Rawls-Meehan
8,046,117 B2 10/2011 Rawls-Meehan
8,050,805 B2 11/2011 Rawls-Meehan
8,052,612 B2 11/2011 Tang
8,065,764 B2 11/2011 Kramer
8,069,852 B2 12/2011 Burton
8,073,535 B2 12/2011 Jung et al.
8,078,269 B2 12/2011 Suzuki et al.
8,078,336 B2 12/2011 Rawls-Meehan
8,078,337 B2 12/2011 Rawls-Meehan
8,083,682 B2 12/2011 Dalal et al.
8,090,478 B2 1/2012 Skinner et al.
8,092,399 B2 1/2012 Sasaki
8,094,013 B1 1/2012 Lee
8,096,960 B2 1/2012 Loree et al.
8,146,191 B2 4/2012 Bobey et al.
8,150,562 B2 4/2012 Rawls-Meehan
8,166,589 B2 5/2012 Hijlkema
8,181,296 B2 5/2012 Rawls-Meehan
8,266,742 B2 9/2012 Andrienko
8,272,892 B2 9/2012 McNeely et al.
8,276,585 B2 10/2012 Buckley
8,279,057 B2 10/2012 Hirose
8,280,748 B2 10/2012 Allen
8,281,433 B2 10/2012 Riley et al.
8,284,047 B2 10/2012 Collins, Jr.

(56) References Cited

U.S. PATENT DOCUMENTS 8,287,452 B2 10/2012 Young et al.
8,336,369 B2 12/2012 Mahoney
8,341,784 B2 1/2013 Scott
8,341,786 B2 1/2013 Oexman et al.
8,348,840 B2 1/2013 Heit et al.
8,350,709 B2 1/2013 Receveur
8,375,488 B2 2/2013 Rawls-Meehan
8,376,954 B2 2/2013 Lange et al.
8,382,484 B2 2/2013 Wetmore et al.
8,386,008 B2 2/2013 Yuen et al.
8,398,538 B2 3/2013 Dothie
8,403,865 B2 3/2013 Halperin et al.
8,413,274 B2 4/2013 Weismiller et al.
8,421,606 B2 4/2013 Collins, Jr. et al.
8,428,696 B2 4/2013 Foo
8,444,558 B2 5/2013 Young et al.
8,620,615 B2 12/2013 Oexman
8,672,853 B2 3/2014 Young
8,682,457 B2 3/2014 Rawls-Meehan
8,769,747 B2 * 7/2014 Mahoney ..... A47C 17/80 5/706
9,370,457 B2 * 6/2016 Nunn ..... A61G 7/015
9,392,879 B2 * 7/2016 Nunn ..... G05B 23/0267
2002/0124311 A1 9/2002 Peftoulidis
2003/0045806 A1 3/2003 Brydon
2003/0166995 A1 9/2003 Jansen
2003/0182728 A1 10/2003 Chapman et al.
2003/0221261 A1 12/2003 Tarbet et al.
2004/0049132 A1 3/2004 Barron et al.
2004/0177449 A1 * 9/2004 Wong ..... A47C 27/082 5/713
2005/0022606 A1 2/2005 Partin et al.
2005/0038326 A1 2/2005 Mathur
2005/0190068 A1 9/2005 Gentry et al.
2005/0283039 A1 12/2005 Cornel
2006/0020178 A1 1/2006 Sotos et al.
2006/0031996 A1 2/2006 Rawls-Meehan
2006/0047217 A1 3/2006 Mirtalebi
2006/0152378 A1 7/2006 Lokhorst
2006/0162074 A1 7/2006 Bader
2007/0118054 A1 5/2007 Pinhas et al.
2007/0149883 A1 6/2007 Yesha
2007/0179334 A1 8/2007 Groves et al.
2007/0180047 A1 8/2007 Dong et al.
2007/0180618 A1 8/2007 Weismiller et al.
2007/0276202 A1 11/2007 Raisanen et al.
2008/0052837 A1 3/2008 Blumberg
2008/0071200 A1 3/2008 Rawls-Meehan
2008/0077020 A1 3/2008 Young et al.
2008/0092291 A1 4/2008 Rawls-Meehan
2008/0092292 A1 4/2008 Rawls-Meehan
2008/0092293 A1 4/2008 Rawls-Meehan
2008/0092294 A1 4/2008 Rawls-Meehan
2008/0093784 A1 4/2008 Rawls-Meehan
2008/0097774 A1 4/2008 Rawls-Meehan
2008/0097778 A1 4/2008 Rawls-Meehan
2008/0097779 A1 4/2008 Rawls-Meehan
2008/0104750 A1 5/2008 Rawls-Meehan
2008/0104754 A1 5/2008 Rawls-Meehan
2008/0104755 A1 5/2008 Rawls-Meehan
2008/0104756 A1 5/2008 Rawls-Meehan
2008/0104757 A1 5/2008 Rawls-Meehan
2008/0104758 A1 5/2008 Rawls-Meehan
2008/0104759 A1 5/2008 Rawls-Meehan
2008/0104760 A1 5/2008 Rawls-Meehan
2008/0104761 A1 5/2008 Rawls-Meehan
2008/0109959 A1 5/2008 Rawls-Meehan
2008/0109965 A1 5/2008 Mossbeck
2008/0115272 A1 5/2008 Rawls-Meehan
2008/0115273 A1 5/2008 Rawls-Meehan
2008/0115274 A1 5/2008 Rawls-Meehan
2008/0115275 A1 5/2008 Rawls-Meehan
2008/0115276 A1 5/2008 Rawls-Meehan
2008/0115277 A1 5/2008 Rawls-Meehan
2008/0115278 A1 5/2008 Rawls-Meehan
2008/0115279 A1 5/2008 Rawls-Meehan
2008/0115280 A1 5/2008 Rawls-Meehan
2008/0115281 A1 5/2008 Rawls-Meehan
2008/0115282 A1 5/2008 Rawls-Meehan
2008/0120775 A1 5/2008 Rawls-Meehan
2008/0120776 A1 5/2008 Rawls-Meehan
2008/0120777 A1 5/2008 Rawls-Meehan
2008/0120778 A1 5/2008 Rawls-Meehan
2008/0120779 A1 5/2008 Rawls-Meehan
2008/0120784 A1 5/2008 Warner et al.
2008/0122616 A1 5/2008 Warner
2008/0126122 A1 5/2008 Warner et al.
2008/0126132 A1 5/2008 Warner
2008/0127418 A1 6/2008 Rawls-Meehan
2008/0127424 A1 6/2008 Rawls-Meehan
2008/0147442 A1 6/2008 Warner
2008/0162171 A1 7/2008 Rawls-Meehan
2008/0262657 A1 * 10/2008 Howell ..... A47C 20/041 700/275
2008/0275314 A1 11/2008 Mack et al.
2008/0281611 A1 11/2008 Rawls-Meehan
2008/0281612 A1 11/2008 Rawls-Meehan
2008/0281613 A1 11/2008 Rawls-Meehan
2008/0288272 A1 11/2008 Rawls-Meehan
2008/0288273 A1 11/2008 Rawls-Meehan
2008/0306351 A1 12/2008 Izumi
2008/0307582 A1 12/2008 Flocard et al.
2009/0018853 A1 1/2009 Rawls-Meehan
2009/0018854 A1 1/2009 Rawls-Meehan
2009/0018855 A1 1/2009 Rawls-Meehan
2009/0018856 A1 1/2009 Rawls-Meehan
2009/0018857 A1 1/2009 Rawls-Meehan
2009/0018858 A1 1/2009 Rawls-Meehan
2009/0024406 A1 1/2009 Rawls-Meehan
2009/0037205 A1 2/2009 Rawls-Meehan
2009/0043595 A1 2/2009 Rawls-Meehan
2009/0064420 A1 3/2009 Rawls-Meehan
2009/0100599 A1 4/2009 Rawls-Meehan
2009/0121660 A1 5/2009 Rawls-Meehan
2009/0139029 A1 6/2009 Rawls-Meehan
2009/0203972 A1 8/2009 Heneghan et al.
2009/0275808 A1 11/2009 DiMaio et al.
2009/0314354 A1 12/2009 Chaffee
2010/0025900 A1 2/2010 Rawls-Meehan
2010/0090383 A1 4/2010 Rawls-Meehan
2010/0094139 A1 4/2010 Brauers et al.
2010/0099954 A1 4/2010 Dickinson et al.
2010/0152546 A1 6/2010 Behan et al.
2010/0170043 A1 7/2010 Young et al.
2010/0174198 A1 7/2010 Young et al.
2010/0174199 A1 7/2010 Young et al.
2010/0191136 A1 7/2010 Wolford
2010/0199432 A1 8/2010 Rawls-Meehan
2010/0231421 A1 9/2010 Rawls-Meehan
2010/0302044 A1 12/2010 Chacon et al.
2010/0317930 A1 12/2010 Oexman et al.
2011/0001622 A1 1/2011 Gentry
2011/0010014 A1 * 1/2011 Oexman ..... A47C 27/061 700/276
2011/0015495 A1 1/2011 Dothie et al.
2011/0041592 A1 2/2011 Schmoeller et al.
2011/0068935 A1 3/2011 Riley et al.
2011/0087113 A1 4/2011 Mack et al.
2011/0094041 A1 4/2011 Rawls-Meehan
2011/0144455 A1 6/2011 Young et al.
2011/0156915 A1 6/2011 Brauers et al.
2011/0224510 A1 9/2011 Oakhill
2011/0239374 A1 10/2011 Rawls-Meehan
2011/0252569 A1 10/2011 Rawls-Meehan
2011/0258784 A1 10/2011 Rawls-Meehan
2011/0282216 A1 11/2011 Shinar et al.
2011/0283462 A1 11/2011 Rawls-Meehan
2011/0291795 A1 12/2011 Rawls-Meehan
2011/0291842 A1 12/2011 Oexman
2011/0295083 A1 12/2011 Doelling et al.
2011/0306844 A1 12/2011 Young
2012/0053423 A1 * 3/2012 Kenalty ..... A61B 5/0015 600/300
2012/0053424 A1 3/2012 Kenalty et al.

(56) References Cited

U.S. PATENT DOCUMENTS

| | | | | |
|---|---|---|---|---|
| 2012/0056729 | A1 | 3/2012 | Rawls-Meehan | |
| 2012/0057685 | A1 | 3/2012 | Rawls-Meehan | |
| 2012/0090698 | A1* | 4/2012 | Giori | A47C 27/083 137/224 |
| 2012/0110738 | A1 | 5/2012 | Rawls-Meehan | |
| 2012/0110739 | A1 | 5/2012 | Rawls-Meehan | |
| 2012/0110740 | A1 | 5/2012 | Rawls-Meehan | |
| 2012/0112890 | A1 | 5/2012 | Rawls-Meehan | |
| 2012/0112891 | A1 | 5/2012 | Rawls-Meehan | |
| 2012/0112892 | A1 | 5/2012 | Rawls-Meehan | |
| 2012/0116591 | A1 | 5/2012 | Rawls-Meehan | |
| 2012/0119886 | A1 | 5/2012 | Rawls-Meehan | |
| 2012/0119887 | A1 | 5/2012 | Rawls-Meehan | |
| 2012/0138067 | A1 | 6/2012 | Rawls-Meehan | |
| 2012/0154155 | A1 | 6/2012 | Brasch | |
| 2012/0186019 | A1 | 7/2012 | Rawls-Meehan | |
| 2012/0198632 | A1 | 8/2012 | Rawls-Meehan | |
| 2012/0311790 | A1 | 12/2012 | Nomura et al. | |
| 2013/0160212 | A1 | 6/2013 | Oexman et al. | |
| 2013/0174347 | A1 | 7/2013 | Oexman et al. | |
| 2014/0007656 | A1 | 1/2014 | Mahoney | |
| 2014/0137332 | A1 | 5/2014 | McGuire et al. | |
| 2014/0182061 | A1 | 7/2014 | Zaiss | |
| 2014/0250597 | A1 | 9/2014 | Chen et al. | |
| 2014/0257571 | A1 | 9/2014 | Chen et al. | |
| 2014/0259417 | A1 | 9/2014 | Nunn et al. | |
| 2014/0259418 | A1 | 9/2014 | Nunn et al. | |
| 2014/0259419 | A1 | 9/2014 | Stusynski | |
| 2014/0259431 | A1 | 9/2014 | Fleury | |
| 2014/0259433 | A1 | 9/2014 | Nunn et al. | |
| 2014/0259434 | A1 | 9/2014 | Nunn et al. | |
| 2014/0277611 | A1 | 9/2014 | Nunn et al. | |
| 2014/0277778 | A1 | 9/2014 | Nunn et al. | |
| 2014/0277822 | A1 | 9/2014 | Nunn et al. | |
| 2015/0007393 | A1 | 1/2015 | Palashewski | |
| 2016/0015184 | A1* | 1/2016 | Nunn | A47C 27/10 700/282 |
| 2016/0242561 | A1* | 8/2016 | Riley | A47C 27/082 |

FOREIGN PATENT DOCUMENTS

| | | |
|---|---|---|
| WO | WO 2008/128250 | 10/2008 |
| WO | WO 2009/108228 | 9/2009 |
| WO | WO 2009/123641 | 10/2009 |

OTHER PUBLICATIONS

U.S. Appl. No. 14/146,327, Palashewski et al., filed Jan. 2, 2014.
International Search Report in International Application No. PCT/US2014/072814, dated Apr. 10, 2015, 4 pages.

* cited by examiner

INFLATABLE AIR MATTRESS WITH INTEGRATED CONTROL

CROSS REFERENCE TO RELATED APPLICATION

This application claims benefit of U.S. Provisional Application Ser. No. 61/921,615 filed Dec. 30, 2013, the contents of which are incorporated herein by reference in its entirety.

TECHNICAL FIELD

This document relates to mattresses, and more particularly, but not by way of limitation, to inflatable air mattress systems.

SUMMARY

In one aspect, an air bed system includes a plurality of peripheral devices. The system further includes a pump unit configured to adjust a firmness of an air mattress, the pump unit includes a pump. The system further includes a controller configured to execute instructions that cause the pump unit to wirelessly pair with at least one of the plurality of peripheral devices. the pump unit is configured to: receive at least one control signal addressed to the at least one of the plurality of peripheral devices, and transmit the at least one control signal to the addressed device.

Implementations can include any, all, or none of the following features. The plurality of peripheral devices include a first peripheral device having a peripheral device controller configured to: receive the at least one control signal transmitted by the controller of the pump device; and control behavior of the associated peripheral device in accordance with the at least one control signal. The plurality of peripheral devices include an adjustable foundation having an adjustable foundation controller in communication with the controller of the pump unit to receive one or more control signals transmitted by the controller of the pump unit; and an air mattress pad having an air controller in communication with the controller of the pump unit to receive one or more control signals transmitted by the controller of the pump unit. The pump unit includes a pump unit housing containing the pump and the controller of the pump unit, wherein the air mattress includes an air chamber, wherein the pump is fluidically connected to the air chamber by an air hose extending from the pump unit housing to the air chamber, and wherein the plurality of peripheral devices are external to the pump unit housing and the air chamber. The plurality of peripheral devices are physically separated from the pump unit. The controller of the pump unit is configured to execute instructions that cause the pump unit to: form a wireless network with the plurality of peripheral devices, each of the peripheral devices including a peripheral device controller configured to 1) form the wireless network with the pump unit and 2) control behavior of the associated peripheral device in accordance with a control signal received from the pump device over the wireless network; and transmit at least one control signal to one of the plurality of peripheral device controllers over the wireless network. The pump unit device further includes an encasement that physically houses the pump and the controller. The instructions further cause the pump unit to: detect a new peripheral device including a peripheral device controller configured to 1) form the wireless network with the pump unit and 2) control behavior of the associated peripheral device in accordance with a control signal received from the pump device over the wireless network; and add the new peripheral device to the wireless network. The instructions further cause the pump unit to receive a data update configured to modify a user interface to include features specific to the new peripheral device. The instructions further cause the pump unit to receive a data update from the new peripheral device.

In one aspect, a method of operating a pump unit of an air bed system. The pump unit includes a pump and a controller, the method includes a method of operating a pump unit of an air bed system. The pump unit includes a pump and a controller. The method further includes adjusting firmness of an air mattress via the pump unit by driving the pump to modify air pressure in an air chamber of the air mattress. The method further includes executing instructions via the controller of the pump unit to cause the pump unit to wirelessly pair with at least one of a plurality of peripheral devices. The method further includes receiving via the controller of the pump unit at least one control signal addressed to the at least one of the plurality or peripheral devices. The method further includes transmitting via the controller of the pump unit the at least one control signal the at least one of the plurality of peripheral devices.

Implementations can include any, all, or none of the following features. The plurality of peripheral devices include a first peripheral device having a peripheral device controller, the method further including receiving by the peripheral device controller the at least one control signal transmitted by the controller of the pump device; and controlling behavior of the associated peripheral device by the peripheral device controller in accordance with the at least one control signal. The pump unit includes a pump unit housing containing the pump and the controller of the pump unit, wherein the pump is fluidically connected to the air chamber by an air hose extending from the pump unit housing to the air chamber, and wherein the plurality of peripheral devices are external to the pump unit housing and the air chamber. The method including forming a wireless network via the pump unit with the plurality of peripheral devices, each of the peripheral devices comprising a peripheral device controller configured to 1) form the wireless network with the pump unit and 2) control behavior of the associated peripheral device in accordance with a control signal received from the pump device over the wireless network; and transmitting at least one control signal via the pump unit to one of the plurality of peripheral device controllers over the wireless network. The method including detecting a new peripheral device via the controller of the pump unit; adding the new peripheral device to the wireless network via the controller of the pump unit; and receiving a data update via the controller of the pump unit to modify a user interface to include features specific to the new peripheral device, wherein the data update is optionally received from the new peripheral device.

In one aspect, a pump unit device includes a pump. The device further includes a controller configured to execute instructions that cause the pump unit to: form a wireless network with a plurality of peripheral devices, each of the peripheral devices includes a peripheral device controller configured to 1) form the wireless network with the pump unit and 2) control behavior of the associated peripheral device in accordance with a control signal received from the pump device over the wireless network. The device further includes transmit at least one control signal to one of the plurality of peripheral device controllers over the wireless network. a pump unit device includes a pump. The device further includes a controller configured to execute instructions that cause the pump unit to: form a wireless network with a plurality of peripheral devices, each of the peripheral devices includes a peripheral device controller configured to 1) form the wireless network with the pump unit and 2) control behavior of the associated peripheral device in accordance with a control signal received from the pump device over the wireless network. The device further includes transmit at least one control signal to one of the plurality of peripheral device controllers over the wireless network.

Implementations can include any, all, or none of the following features. The pump unit device further includes an encasement that physically houses the pump and the controller. The instructions further cause the pump unit to: detect a new peripheral device including a peripheral device controller configured to 1) form the wireless network with the pump unit and 2) control behavior of the associated peripheral device in accordance with a control signal received from the pump device over the wireless network; and add the new peripheral device to the wireless network. The instructions further cause the pump unit to receive a data update configured to modify a user interface to include features specific to the new peripheral device. The instructions further cause the pump unit to receive a data update from the new peripheral device.

BRIEF DESCRIPTION OF DRAWINGS

Some embodiments are illustrated by way of example and not limitation in the figures of the accompanying drawings in which.

DETAILED DESCRIPTION

Figure 1:
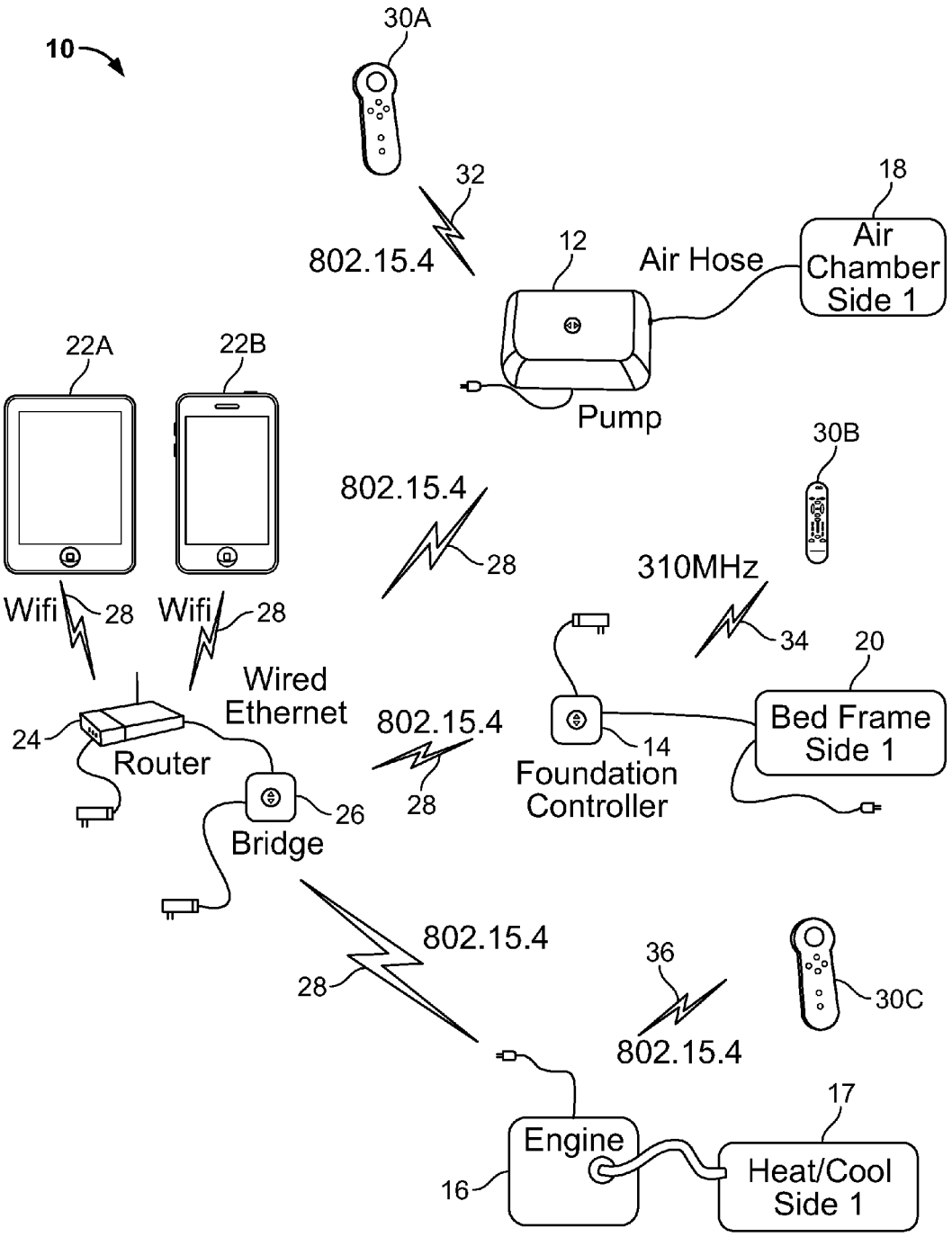
FIG. 1 is a block diagram of an example of an air bed system.

FIG. 1 is a block diagram of an example of an air bed system. In FIG. 1, the air bed system 10 may include a pump 12 having a controller (not depicted), a foundation controller 14 for controlling an adjustable foundation, and a thermoelectric engine 16 for heating/cooling air mattress pad 17. The pump 12 is configured to control the firmness of an air chamber, e.g., side 1 of an air chamber 18. The foundation controller 14 is configured to control the articulation of a bed frame, e.g., side 1 of a bed frame 20. It should be noted that for purposes of conciseness FIG. 1 depicts the pump 12, the foundation controller 14, and the thermoelectric engine 16 as controlling only one side, e.g., side 1, of the air bed system 10. In some example configurations, the pump 12, the foundation controller 14, and the thermoelectric engine 16 may each control two sides of an air bed system 10.

As depicted in FIG. 1, smart devices 22A, 22B (collectively referred to in this disclosure as "smart devices 22"), such as a smart phone and a tablet computer, may transmit control signals to one or more of the pump 12, the foundation controller 14, and the thermoelectric engine 16. In one specific configuration, the smart devices 22 may communicate via WiFi signals to a wireless router 24. The wireless router 24 may be connected, e.g., via a wired connection, to a bridge 26.

As seen in FIG. 1, the control signals 28 transmitted by the smart devices 22 may be received via the router 24 and then transmitted to one or more of the pump 12, the foundation controller 14, and the thermoelectric engine 16 by way of the bridge 26. In one specific example implementation, the bridge 26 may transmit the control signals 28 using a communication protocol such as IEEE 802.15.4 to one or more of the pump 12, the foundation controller 14, and the thermoelectric engine 16. A person of ordinary skill in the art will recognize that numerous other communication protocols may be used to transmit the control signals.

In addition to the smart devices 22, one or more remote controls may be used to transmit control signals to one or more of the pump 12, the foundation controller 14, and the thermoelectric engine 16. For example, a remote control 30A may transmit control signals 32 to the pump 12, a remote control 30B may transmit control signals 34 to the foundation controller 14, and a remote control 30C may transmit control signals 36 to the thermoelectric engine 16. The remote controls 30A, 30B, and 30C are collectively referred to in this disclosure as "remote controls 30." The remote controls 30 may communicate using any number of communication techniques, including, for example, IEEE 802.15.4, radio frequency (RF), such as at 310 Megahertz (MHz), infrared, and the like.

As seen in the example configuration shown in FIG. 1, the control signals 28 from the smart devices 22 are transmitted from the bridge 26 to one or more of the pump 12, the foundation controller 14, and the thermoelectric engine 16. In some example configurations, the bridge 26 may broadcast the control signals to each of the pump 12, the foundation controller 14, and the thermoelectric engine 16, and then the relevant device(s), e.g., the pump 12, performs the requested function, e.g., increase the firmness of an air chamber, while the other devices, e.g., the foundation controller 14 and the thermoelectric engine 16, determine that the control signal is a pump-specific command and thus disregard the control signal.

In other example configurations, the bridge 26 may broadcast one or more device-specific control signals to one or more specific devices, e.g., the pump 12, which performs the requested function, e.g., increase firmness of an air chamber, while the other devices, e.g., the foundation controller 14 and the thermoelectric engine 16, do not receive the device-specific control signal.

Thus, in the system shown in FIG. 1, the control signals 28 may be transmitted from the bridge 26 to multiple devices, such as the pump 12, the foundation controller 14, and the thermoelectric engine 16. In this manner, the bridge 26 acts as a hub that distributes the control signals to the various devices of the air bed system. The bridge 26, however, is not part of the air bed system. In the system of FIG. 1, a device of the air bed system, e.g., the pump 12, is unaware of the state of the other devices of the system 10, e.g., the foundation controller 14 and the thermoelectric engine 16.

In contrast to the system 10 shown and described above with respect to FIG. 1 and in accordance with various techniques of this disclosure, one device of the air bed system, e.g., the pump 12, may act as a hub. For example, as described in more detail below, the pump 12 may receive all air bed related control signals from the smart devices 22 and then transmit the received control signals to the specific, relevant devices.

Figure 2:
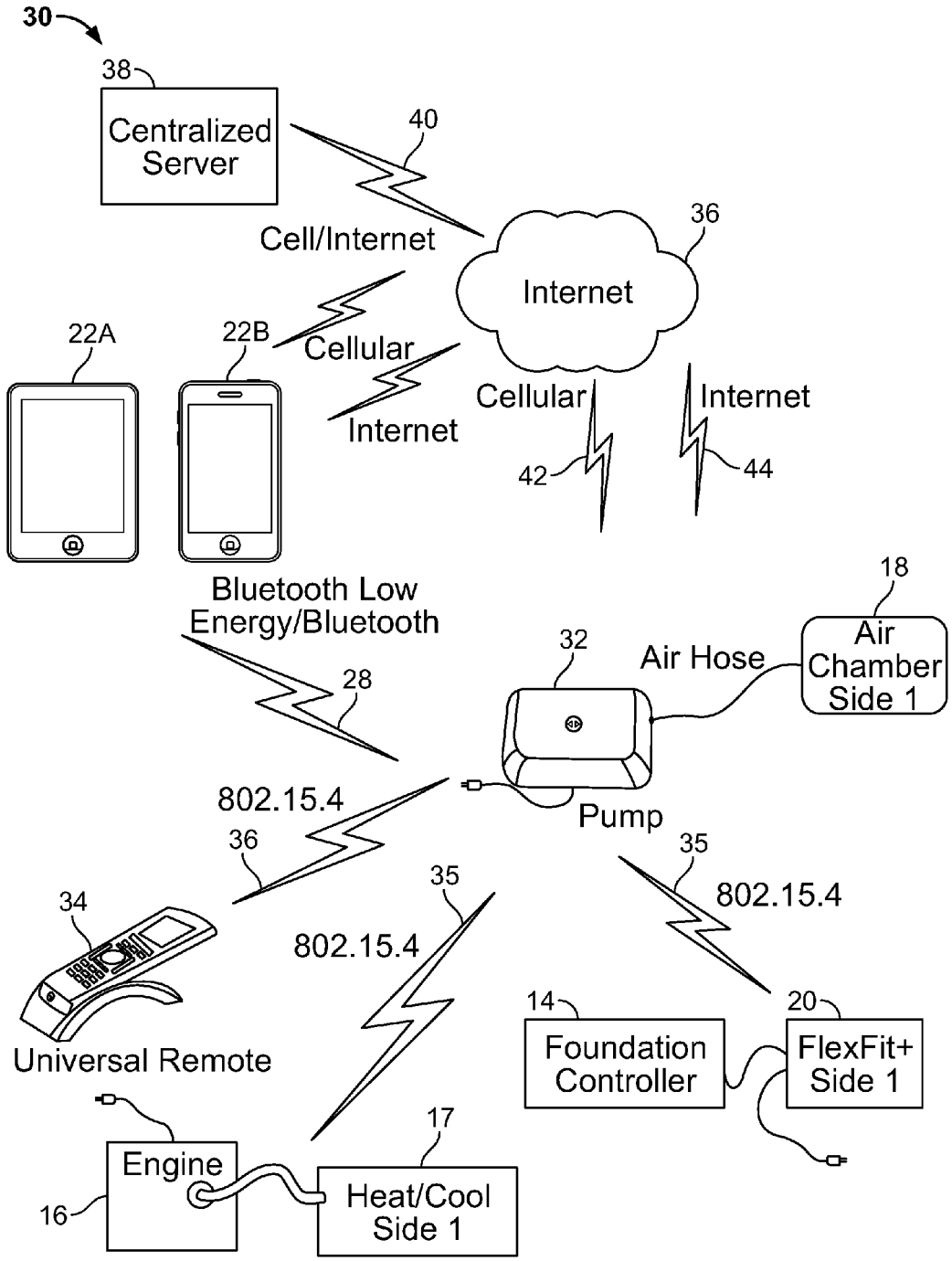
FIG. 2 is a block diagram of an example of an air bed system in accordance with various techniques of this disclosure.

FIG. 2 is a block diagram of an example of an air bed system 30 in accordance with various techniques of this disclosure. Like in FIG. 1, the air bed system 30 in FIG. 2 may include a pump 32 having a controller (not depicted) (collectively a "pump unit"), a foundation controller 14, and a thermoelectric engine 16. In contrast to the system in FIG. 1, the smart devices 22 may communicate directly with the pump 32, rather than through the router 24 and the bridge 26 of FIG. 1. It should be noted that for purposes of conciseness, FIG. 2 depicts the pump 32, the foundation controller 14, and the thermoelectric engine 16 as controlling only one side, e.g., side 1, of the air bed system 30. In some example configurations, the pump 32, the foundation controller 14, and the thermoelectric engine 16 may each control two sides of an air bed system.

As seen in FIG. 2, the control signals 28 transmitted by the smart devices 22 may be received by a single device of the air bed system, e.g., the pump 32. Additionally or alternatively, the system may include a universal remote control 34 that may transmit the control signals 36 to the single device of the air bed system, e.g., the pump 32. Then, the single device, e.g., the pump 32, may act on the control signal if the control signal is designated for that device, e.g., a control signal to increase the firmness of an air chamber. If the control signal is not designated for that device, e.g., the pump 32, the device may transmit the control signal to another device of the air bed system, e.g., the foundation controller 14 or the thermoelectric engine 16, for which the control signal is designated. Thus, using the techniques of this disclosure, one device of the air bed system, e.g., the pump 32, may be aware of the state of each of the other devices of the air bed system.

For example, because the pump 32 receives all the control signals from the smart devices 22 and/or the universal remote control 34 and either acts upon or transmits those control signals to the various components of the air bed system, the pump 32 has state awareness of all the devices of the system. By way of specific example, a user may use the smart device 22 (or the universal remote control 34) to transmit control signals to increase the firmness of the air mattress and raise a head portion of the frame of the air bed system. The pump 32 receives the control signals and determines, e.g., via a controller in the pump (not depicted), that it (the pump 32) is the designated recipient of one of the control signals and acts accordingly to increase the firmness of the air mattress. After determining that the other control signal is designated for the foundation controller 14, the pump 32 transmits the control signal to the foundation controller 16. In response, the foundation controller 14 controls one or more articulation motors (not depicted) in order to raise the head portion of the frame. Because the pump 32 received both control signals, the pump 32 is aware of the position of the frame. In this manner, the pump has state awareness of all the devices of the system.

The control signals transmitted by the smart devices 22 and/or the universal remote control 34 to the pump 32 may use any one or more of numerous wireless communication standards, including, for example, Bluetooth, Bluetooth low energy (LE), Wi-Fi, cellular, IEEE 802.15, and the like. Similarly, the control signals 35 transmitted by the pump 32 to the various other components of the system may use any one or more of numerous wireless communication standard, including, for example, Bluetooth, Bluetooth LE, Wi-Fi, cellular, IEEE 802.15, and the like.

In some example implementations, the pump 32 may be connected to the Internet 36 in order to transmit/receive signals to/from a centralized server 38. For example, in order to ensure that a controller of the pump 32 includes the most recent firmware, the centralized server 38 may transmit a signal 40 over the Internet 36, requesting that the pump 32 transmit a signal that includes its firmware version. Alternatively, the centralized server 38 may transmit a signal over the Internet 36 that indicates the most recent firmware version. If the firmware version is not the most recent version, as determined by either the centralized server 38 or the pump 32, the centralized server 38 may transmit a control signal to the pump 32 that instructs the pump 32 to download the most recent firmware version or the centralized server 38 may transmit the most recent firmware version when the firmware and the pump 32 are available. The pump 32 may update its firmware and/or push the firmware to the universal remote control 34 for updating, e.g., to update a user interface on the remote control 34. The pump 32 and the centralized server 38 may be connected to the Internet 36 using a cellular connection 42 or a network connection 44, such as a wireless network connection or a wired network connection.

In addition, the system depicted in FIG. 2 may be used to perform diagnostics on one or more components of the system pump 32. For example, the pump 32 may determine that an error condition exists in one or more of the pump 32, the foundation controller 14, and the thermoelectric engine 16. The pump 32 may communicate the error condition to the centralized server 38 and the centralized server 38 may transmit signals including one or more instructions that, when executed by a controller of the pump 32, may then execute instructions in an attempt to correct the error condition.

It should be noted that the various functionalities ascribed to the pump 32 in this disclosure are achieved by the pump controller (which is not depicted for simplicity) executing instructions that are stored in a computer readable medium, for example.

Figure 3:
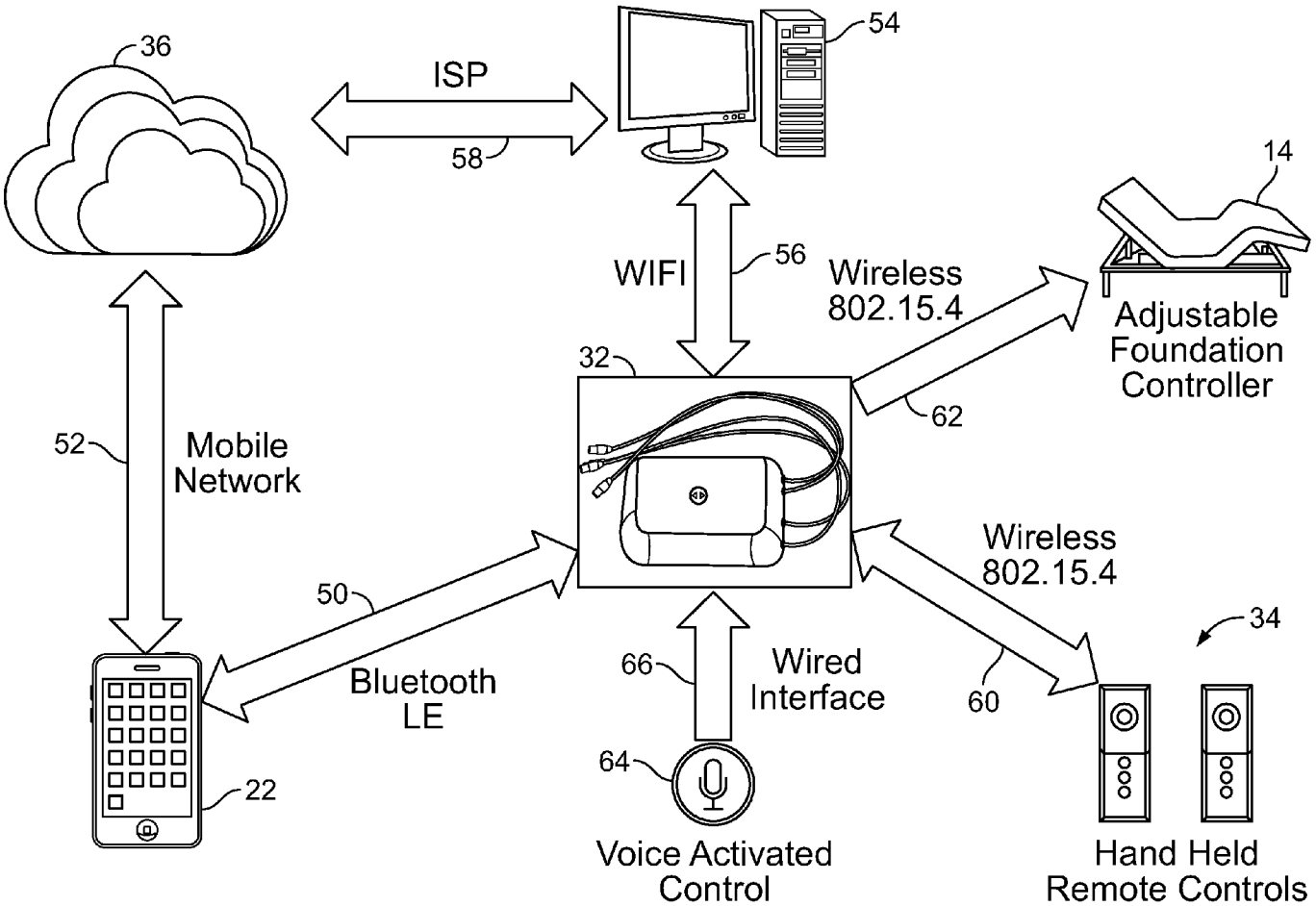
FIG. 3 is a conceptual diagram depicting an example communications configuration between various components of an air bed system in accordance with various techniques of this disclosure.

FIG. 3 is a conceptual diagram depicting an example communications configuration between various components of an air bed system. The non-limiting example configuration in FIG. 3 is for illustrative purposes only. In FIG. 3, the pump 32 may be connected to various air bed system components or other components using wireless or wired connection techniques.

For example, the smart device 22 may be wirelessly connected to the pump 32 via a Bluetooth connection 50, such as Bluetooth LE. In addition, the smart device 22 may be connected to the Internet 36 via a cellular connection 52 over a mobile communications network.

A computer 54, e.g., desktop or laptop computer, may communicate with the pump 32 via a wireless connection 56, e.g., Wi-Fi connection. In addition, the computer 54 may be connected to the Internet 36 by Internet Service Provider (ISP) 58. The computer 54 may be used to collect data from the components of the air bed system, e.g., the pump 32 and the adjustable foundation controller 14, and, in some examples, transmit the data over the Internet 36 for further analysis, e.g., by the centralized server 38 of FIG. 2.

One or more hand held universal remote controls 34 may be wirelessly connected to the pump 32 using IEEE 802.15.4, for example, as shown at 60. Similarly, the foundation controller 14 may be wirelessly connected to the pump 32 using IEEE 802.15.4, as shown at 62. Finally, the pump 32 may be controlled using voice activated control 64. The voice activated control 64 may be connected to the pump 32 using a wired interface 66.

The communication standards and protocols described above with respect to FIG. 3 are for illustrative purposes only. Those having ordinary skill in the art will understand upon reading this disclosure that numerous other standards and protocols may be used to implement various techniques of this disclosure.

Figure 4:
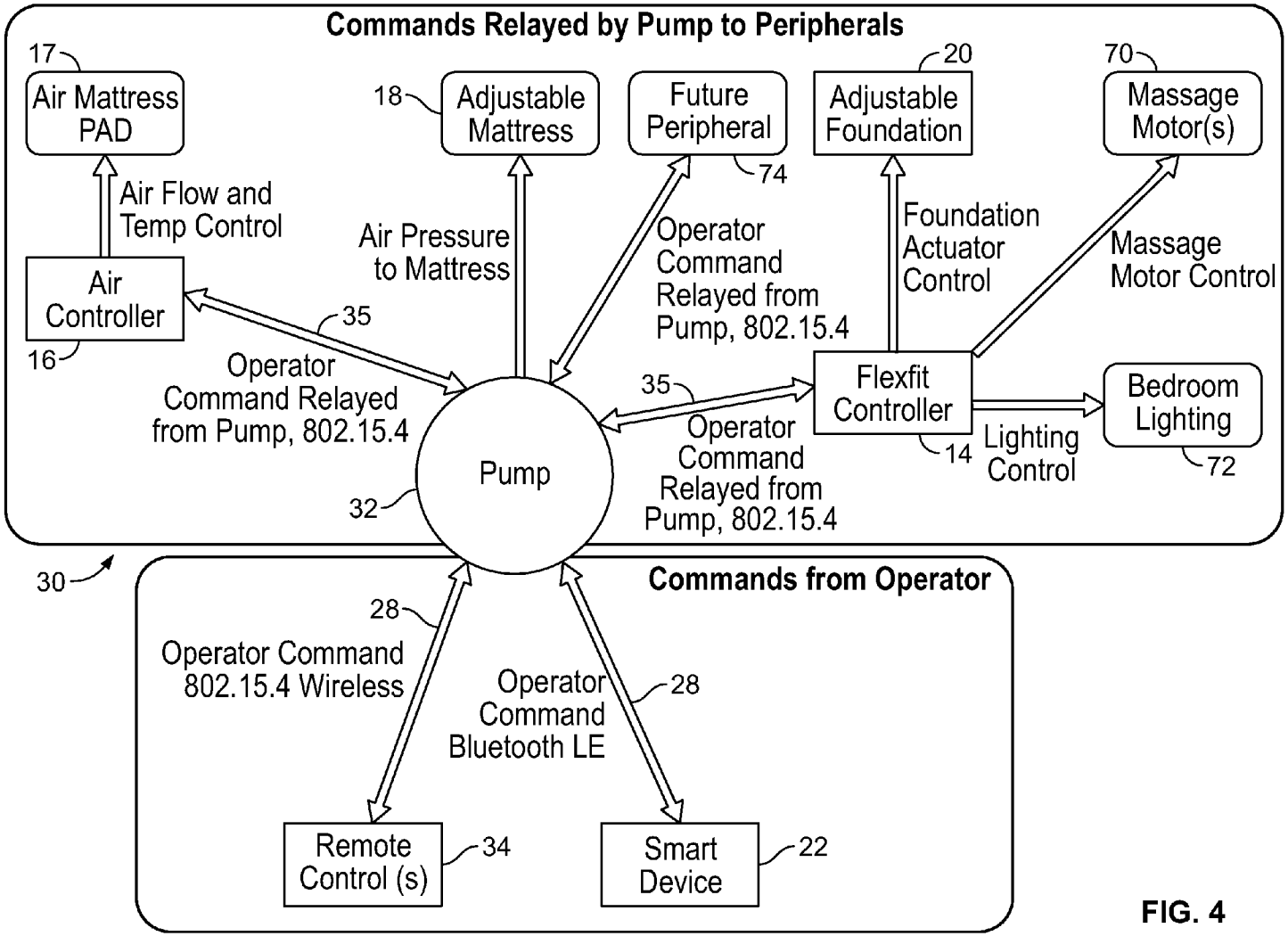
FIG. 4 is a conceptual diagram depicting communications between a pump of an air bed system and various peripheral devices in accordance with this disclosure.

FIG. 4 is a conceptual diagram depicting communications between a pump of an air bed system and various peripheral devices, in accordance with this disclosure. As seen in FIG. 4, the pump 32 is a hub of the air bed system 30 with numerous peripherals in communication therewith. As described above, one or more users (or "operator") may use a smart device 22 or remote control 34 to transmit control signals to the pump 32. For example, in FIG. 4, the smart device 22 may transmit control signals 28 wirelessly to the pump 32 using Bluetooth LE and the remote control 34 may transmit control signals wirelessly to the pump 32 using IEEE. 802.15.4.

In response to receiving the control signals 28 from the user, the pump 32 may act on the command, e.g., adjusting the air pressure to the adjustable air mattress 18, or transmit the control signal to one of the peripherals in the system. As seen in FIG. 4, the peripherals may include, but are not limited to, an air mattress pad 17, the adjustable foundation 20, a massage motor 70, and bedroom lighting 72.

In the example shown in FIG. 4, the flexfit or foundation controller 14 may control operation of the adjustable foundation 20, the massage motor 70, and the bedroom lighting 72 using wireless control signals 35 sent using IEEE 802.15.4, for example, from the pump 32. Similarly, the air controller or thermoelectric engine 16 may control operation of the air mattress pad 17 using wireless control signals 35 sent using IEEE 802.15.4, for example, from the pump 32.

In accordance with this disclosure and as shown in FIG. 4, one or more future peripherals 74 may be wirelessly controlled by the pump 32, e.g., using control signals sent using IEEE 802.15.4. Because the system peripherals and, in particular, the future peripherals 74, may wirelessly pair with the pump 32, the expandability of the air bed system is not constrained by any physical connectors. For example, the air bed system of this disclosure is not constrained by the number of connectors that may be mounted on the system hub, e.g., the pump 32. As such, future peripherals 74 may be easily added to the air bed system 30 by the user in an almost limitless fashion, constrained only by the number of bindings supported by the controller of the pump 32.

Future peripherals 74 include, but are not limited to, a home alarm system, home lighting, television(s), room shades, and room and/or home temperature. Upon acquiring a future peripheral 74, the user may pair the future peripheral 74 to the pump 32 and begin controlling that particular device, e.g., a television, using the control signals sent to the pump 32 from the smart device 22 or a universal remote control 34, for example. In this way, the air bed system 30 of this disclosure is designed for unknown, future peripherals to allow for seamless communication and expandability.

An ad-hoc pairing between a peripheral and the pump 32 may be created by automatically or manually binding at least two devices, e.g., a future peripheral such as a television and the pump 32. The creation of ad-hoc wireless networks is well known to those of ordinary skill in the art and, as such, need not be described in detail in this disclosure.

In addition, in some example configurations, the peripherals, e.g., the future peripherals, may include firmware to allow for automatic firmware updates upon binding with the pump 32. For example, upon manually or automatically binding with the pump 32, a new peripheral, e.g., a television, may transmit the new firmware to the remote control 34 through the pump 32 in order to update a user interface on the remote control 34. The updated user interface may include features specific to control of the new peripheral, e.g., the television. In this manner, the user can see the new user interface without having to purchase a new remote control 34 or a new pump 32. Additionally, such a configuration in which the new peripheral includes the new firmware for the remote control 34 and/or the pump 32, reduces or eliminates the need for the centralized server 38 of FIG. 2 to perform a full push of the firmware out to the pump 32 (and then to the remote control 34, for example).

In various examples, the controllers and devices described above, e.g., the controller of the pump 32, the foundation controller 14, the thermoelectric engine 16, may each include a processor, a storage device, and a network interface. The processor may be a general purpose central processing unit (CPU) or application-specific integrated circuit (ASIC). The storage device may include volatile or non-volatile static storage (e.g., Flash memory, RAM, EPROM, etc.). The storage device may store instructions which, when executed by the processor, configure the processor to perform the functionality described herein. For example, a processor of the foundation controller may be configured to send a command to a motor to adjust a position of the foundation.

In various examples, the network interface of the components may be configured to transmit and receive communications in a variety of wired and wireless protocols. For example, the network interface may be configured to use the 802.11 standards (e.g., 802.11a/b/c/g/n/ac), PAN network standards such as 802.15.4 or Bluetooth, infrared, cellular standards (e.g., 3G/4G etc.), Ethernet, and USB for receiving and transmitting data. The previous list is not intended to exhaustive and other protocols may be used. As shown and described above, not all components need to be configured to use the same protocols.

In various examples, the pump 32 is configured to analyze data collected by a pressure transducer to determine various states of a person lying on the bed. For example, the pump 32 may determine the heart rate or respiration rate of a person lying in the bed. Additional processing may be done using the collected data to determine a possible sleep state of the person. For example, the pump 32 may determine when a person falls asleep and, while asleep, the various sleep states of the person. Further, because the pump 32 acts a hub to the system and, as such, has state awareness of all of the peripheral devices, e.g., the foundation controller 14, a television, the thermoelectric engine 16, the pump may utilize the state information to analyze sleep data of the user. For example, the pump 32 (in particular the controller of the pump 32) may determine that a user achieves a desired sleep state more quickly if the adjustable foundation is in a particular position. The pump 32 may communicate this analysis to the computer 54, thereby allowing the user to react accordingly.

Although an embodiment has been described with reference to specific example embodiments, it will be evident that various modifications and changes may be made to these embodiments without departing from the broader spirit and scope of the invention. Accordingly, the specification and drawings are to be regarded in an illustrative rather than a restrictive sense. The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled. As it common, the terms "a" and "an" may refer to one or more unless otherwise indicated.

What is claimed is:

1. An air bed system comprising:

a plurality of controllable peripheral devices, each of the controllable peripheral-devices including a peripheral device controller configured to control behavior of the associated peripheral device;

a control device; and a pump in a pump housing, wherein the pump is configured to:

adjust a firmness of an air chamber of an air mattress, wirelessly pair with at least one peripheral device controller of at least one of the plurality of controllable peripheral devices, receive at least one control signal from the control device, the control signal being addressed to the at least one of the plurality of controllable peripheral devices, wherein the control device is in data communication with the pump and configured to generate the control signal, and transmit the at least one control signal to the peripheral device controller of the addressed controllable peripheral device, wherein the plurality of controllable peripheral devices are external to the pump housing and the air chamber.

2. The air bed system of claim 1, wherein the plurality of controllable peripheral devices comprise:

an adjustable foundation having an adjustable foundation controller in communication with the pump to receive one or more control signals transmitted by the pump; and an air mattress pad having an air controller in communication with the controller of the pump to receive one or more control signals transmitted by pump.

3. The air bed system of claim 1, wherein the pump is fluidically connected to the air chamber by an air hose extending from the pump, through the pump housing.

4. The air bed system of claim 1, wherein the plurality of controllable peripheral devices are physically separated from the pump.

5. The air bed system of claim 1, wherein the pump comprises a controller in the pump housing.

6. The air bed system of claim 1, wherein the pump is further configured to:

detect a new controllable peripheral device comprising a new peripheral device controller: and wirelessly pair with the new peripheral device controller of the new controllable peripheral device.

7. The air bed system of claim 1, wherein the pump is further configured to receive a data update configured to modify a user interface to include features specific to a peripheral device.

8. The air bed system of claim 6, wherein the pump is further configured to receive a data update from the new controllable peripheral device.

9. The air bed system of claim 1, wherein the pump comprises a controller.

10. The air bed system of claim 1, wherein the control device is a remote control device.

11. The air bed system of claim 1, wherein the control device is a smart phone.

12. The air bed system of claim 1, wherein the at least one of the plurality of controllable peripheral devices comprises a motor, wherein the control signal is a signal to operate the motor, and wherein the at least one peripheral device controller is configured to control operation of the motor in response to receiving the at least one control signal from the pump.

* * * * *